United States Patent [19]

Cooper

[11] 4,161,208

[45] Jul. 17, 1979

[54] INVESTMENT CASTING APPARATUS

[76] Inventor: Abraham J. Cooper, 348 Country Club La., Pomona, N.Y. 10970

[21] Appl. No.: 857,113

[22] Filed: Dec. 5, 1977

[51] Int. Cl.[2] ..... B22C 7/02

[52] U.S. Cl. ..... 164/244; 164/246; 164/DIG. 4

[58] Field of Search ..... 164/244, 246, 249, DIG. 4; 249/173

[56] References Cited

U.S. PATENT DOCUMENTS

| | | | |
|---|---|---|---|
| 3,648,760 | 3/1972 | Cooper | 164/244 |
| 3,974,996 | 8/1976 | Violet | 249/173 X |
| 4,003,423 | 1/1977 | Shikinai et al. | 164/246 X |

*Primary Examiner*—Robert D. Baldwin
*Attorney, Agent, or Firm*—Albert F. Kronman

[57] ABSTRACT

A precision investment casting assembly has a model support consisting of a central upstanding sprue former and outwardly extending tubes to support wax models. The sprue former is held at one end by a resilient base. A somewhat key-hole shaped recess in the base receives a split flask which encircles the support. An elongated pin engages the free edges of the split flask to close it while embedment material is poured around the support. The pin is removed to release the flask from the embedment material after casting. Proper orientation of the support elements is aided by a plurality of keys and keyways.

5 Claims, 14 Drawing Figures

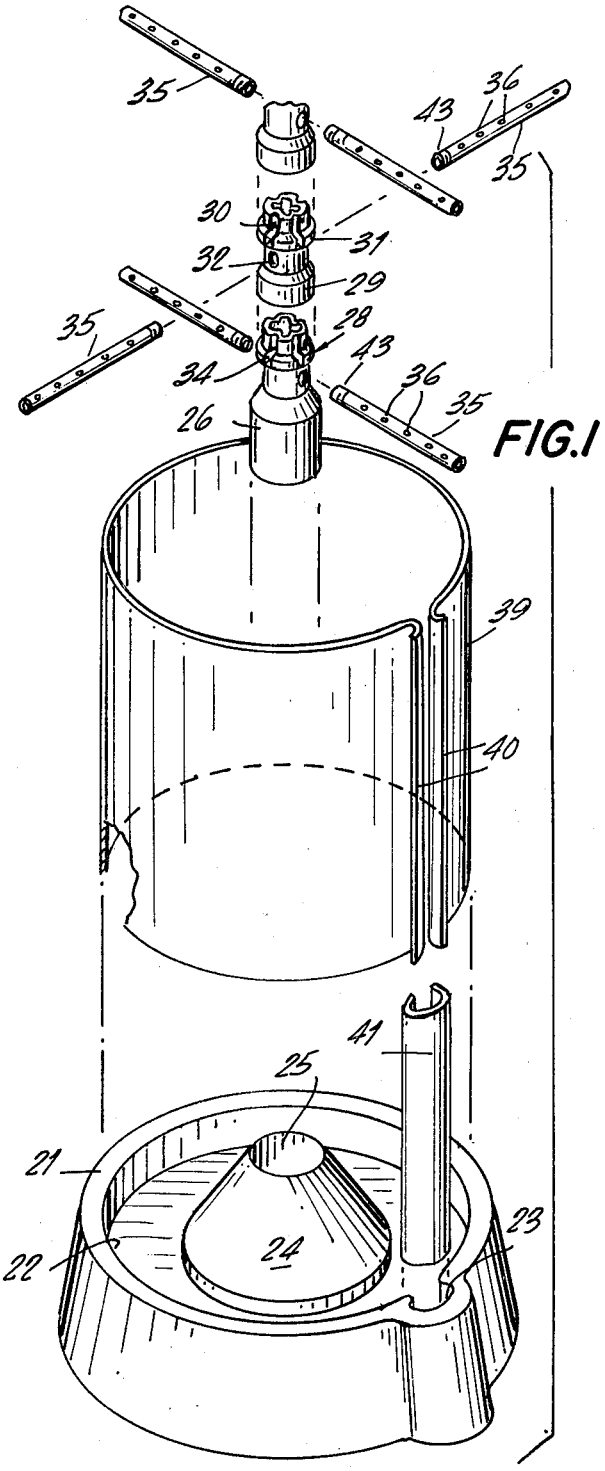
FIG. 1
FIG. 4
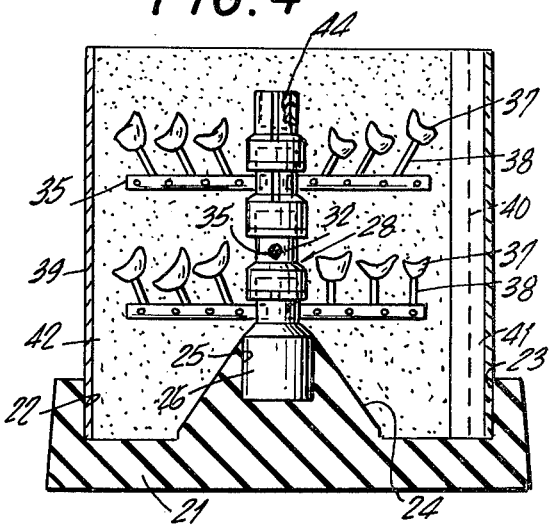
FIG. 5
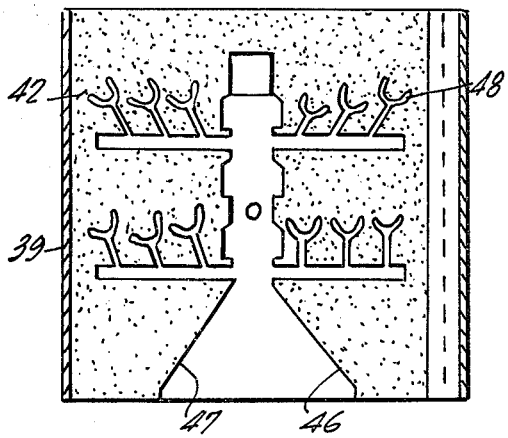
FIG. 2
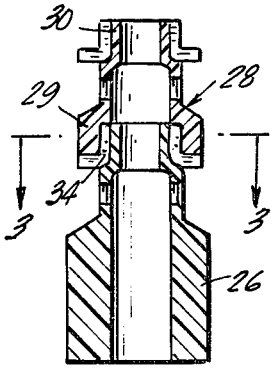
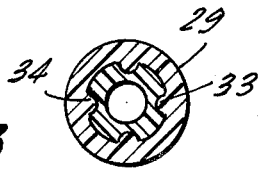
FIG. 3

INVESTMENT CASTING APPARATUS

BACKGROUND OF THE INVENTION

Producing small castings by the lost wax method has been disclosed in prior U.S. patents such as U.S. Pat. No. 3,648,760, issued Mar. 14, 1972 and No. 3,985,178, issued Oct. 12, 1976. These patents also disclose the use of plastics and wax having different melting points to aid in forming a suitable metal receiving cavity.

Where the castings are in the form of a plurality of very small articles such as is common in dental restorations, jewelry or the like, all of which are to be cast at the same time, prior art devices, require a great amount of time consuming skill particularly where the models are closely grouped within the casting flask.

Accordingly, it is an object of the present invention to provide a precision investment casting apparatus which will greatly facilitate the casting of a substantial number of small articles within a single flask.

Another object of the present invention is to provide casting apparatus which will lend itself to a variety of casting operations.

A further object of the present invention is to provide casting apparatus which may be assembled by persons with less skill than required for previous systems.

A feature of the present invention is its use of a combined plug and socket member which can be assembled to form a sprue as the casting tree is built up.

Another feature of the present invention is its flask construction which aids in removing the flask from the lost wax embedment.

SUMMARY OF THE INVENTION

The precision investment casting tree according to the present invention is formed of a relatively high-melting point plastic built up of a plurality of axially bored combined plug and socket members. Lateral openings in the plug and socket members receive outwardly extending hollow tubes. A plurality of openings in the tubes communicate with the interior thereof. Wax models of the objects to be cast are secured upon the tube adjacent the openings. The tree is held at one end by a centrally apertured base of resilient material having a somewhat keyholed recess therein. An elongated split ring having outwardly extending flanges and an elongated flange engaging clip is secured at one end in the recess and around the tree to form, with the base, a flask to receive embedment material. Openings in the plug and socket members and keys receivable within keyways on adjacent plug and socket members enable the operator to offset successive models as the assembly is constructed.

BRIEF DESCRIPTION OF THE DRAWINGS

In the accompanying drawings forming part hereof, similar parts have been given the same reference numerals, in which drawings:

FIG. 1 is a somewhat exploded isometric view of a complete embodiment of the present invention.

FIG. 2 is a detailed view in vertical section of the base of the central sprue forming structure shown in FIG. 1.

FIG. 3 is a view in cross section taken on line 3—3 in FIG. 2.

FIG. 4 is an elevation, partly in section, of the casting apparatus fully assembled following the pouring of the embedment material.

FIG. 5 is a view similar to FIG. 4 with the casting tree and models melted out.

GENERAL DESCRIPTION

Figure 6:
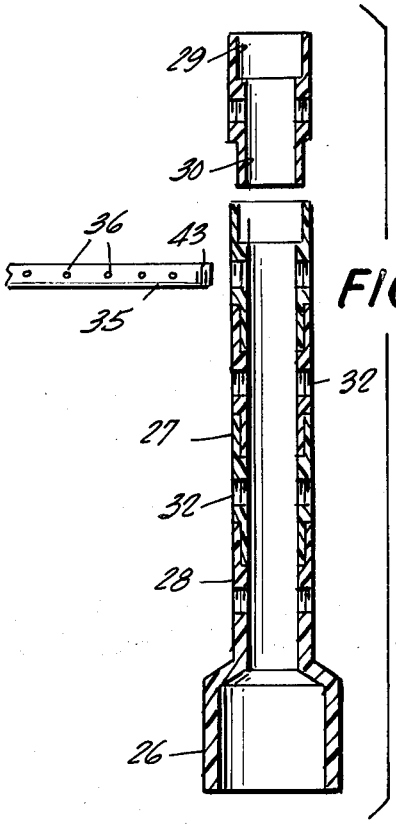
FIG. 6 is a somewhat exploded view showing the manner in which the tree components are secured together.
Figure 8:
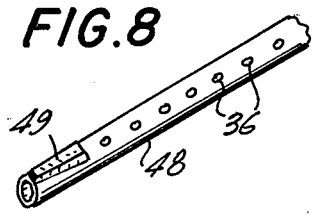
FIGS. 7–14 are fragmentary views of various securing structures for the tree elements.
Figure 9:
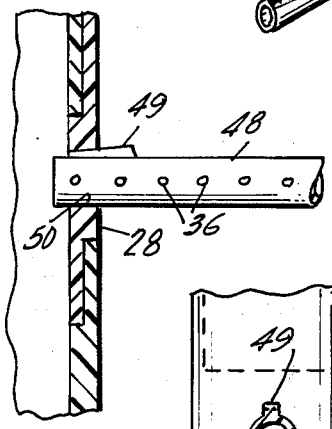
Figure 10:
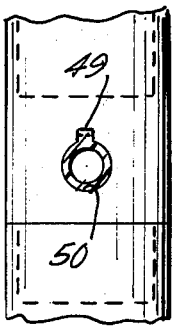
Figure 7:
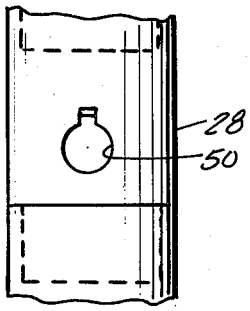

Referring to the drawings and particularly FIGS. 1–5, there is shown a resilient base 21 made of natural or synthetic rubber which may be circular, as shown, or of any other convenient shape. A first recess 22 is provided in the top of the base 21 inwardly spaced from the periphery thereof. A second smaller recess 23 is laterally disposed with respect to the first recess but in communication therewith as best shown in FIG. 1. The resilient base 21 has a frustum shaped protuberance in the center thereof which protuberance is formed with a socket 25 at its top portion.

The socket 25 is adapted to receive a somewhat cylindrical anchor member 26, as best shown in FIG. 4. The anchor member secures a sprue forming assembly 27 to the protuberance 24, for a hereinafter more fully described purpose.

Plug and socket members 28 each consist of a lower hollow portion 29 forming the socket and an upper reduced portion 30 forming the plug. An annular flange 31 on the plug 30 acts as a stop for the adjacent socket portion when the members 28 are assembled. The flange 31 is spaced from the plug portion and a transverse bore 32 is provided between the flange 31 and the top of the socket 29. Each socket 29 is provided with inwardly disposed keys 33 to engage keyways 24 in the plug members (see FIGS. 1 and 3). The plug and socket members are axially bored.

It will be apparent from the above that the sprue forming assembly 27 can be made to any desired length depending upon the number of models that are to be cast in a single operation. The cylindrical anchor member 26 is frictionally fitted within the socket 25 so that it may be removed therefrom as desired. The cylindrical anchor 26 and the sprue forming assembly 27 are preferably made of a suitable plastic such as polypropylene, which plastic is selected to have a melting point somewhat higher than that of the wax commonly employed in lost wax casting operations. A series of hollow tubes 35 complete the sprue forming tree and are made of the same plastic material as the plug and socket members 28. The tubes 35 are provided with spaced openings 36 which are in communication with the interior of the hollow tubes. It will be seen from an examination of FIG. 1 that the plug and socket members 28 may be offset 90° from each other when they are assembled as the sprue forming assembly. Offsetting the plug and socket members 28 serves to dispose the tubes 35 along an axis at right angles to the adjacent tubes. In this manner, more space is provided for the models 37 which are to be attached to the tubes 35.

The models 37 which are shown in the drawings as dental restoration caps, but which may comprise any small article such as rings, jewelry, buttons, etc. are secured to the tubes 35 by means of wax under hollow tubes 38. The pins 38 are attached to the individual wax models by heating in the well-known manner. The opposite end of the pins are heated and secured to the tubes 35 in communication with the openings 36. It will be understood, that the operator first places one or more tubes 35 within the bore 32 and secures it in place. For this purpose there has been shown various attaching means which may comprise the threads 43 shown in FIGS. 1 and 6 or the other embodiments shown in FIGS. 7–13. After one set of tubes is in place within the plug and socket members 28, the models to be supported by that tube are attached. Thereafter, a second plug and socket member 28 is slipped into place, tubes for this second plug and socket member are applied and an additional set of models attached. The assembly continues until it is entirely built up.

After the assembly of the sprue forming members and the models has been completed, an elongated split ring 39, best shown in FIG. 1, is slipped over the assembly and slipped within the recess 22 of the base. The longitudinal margins of the split ring 39 are provided with outwardly extending flange portions 40, the bottoms of which are received within the second recess 23. An elongated split pin 41 is then slipped over the flanges 40 and slid down into the second recess 23. In this manner, a flask is formed into which embedment material 42 may be poured.

A small wax stop 44 is slipped into the opening 45 in the top-most plug 30. The stop 44 prevents embedment material from getting into the sprue forming assembly 27 during the next step of the operation.

Embedment material 42 is next poured into the flask until it completely surrounds all of the elements assembled therein as shown in FIG. 4. The embedment material which may be phosphate-silica or any other well-known embedment material is then allowed to harden within the flask and around the assembled models and sprue forming elements.

After the embedment material has hardened, the resilient base 21 is pulled free of the split ring and the casting therein following which the split ring 39 and its contents are heated to a temperature of between 350° to 900° F. at which temperatures the wax forming the models 37 and the pins 38 will melt. The melted wax will flow downwardly through the openings 36 in the pins 35 and down through the bores of the sprue forming assembly 27. Thereafter, the temperature is increased to a point where the polypropylene or other plastic material will melt and flow out of the embedment resulting in a cavity which is shown in FIG. 5. This cavity, hereinafter the casting cavity 46, provides a metal receiving funnel 47 and passageways in the nature of a sprue cavity leading to each of the model cavities 48 (see FIG. 5).

Casting of the metal may be accomplished by placing the mold in a vacuum machine or centrifugal device, as is well-known in the art, whereby metal is forced into the entire cavity formed in the embedment material 42.

It is within the purview of the present invention to provide other means for attaching the tubes 35 to the plug and socket members 28. Such embodiments are shown in FIGS. 7–14.

In FIGS. 7, 8, 9, and 10, there is shown a tube 48 having a wedge shaped member 49 formed at one end thereof which wedge is received within a keyhole shaped opening 50 in the plug and socket member 28. As the tube 48 is pressed into place, a firm attachment is achieved while at the same time insuring that the openings 36 in the tube 48 are in proper orientation.

Figure 11:
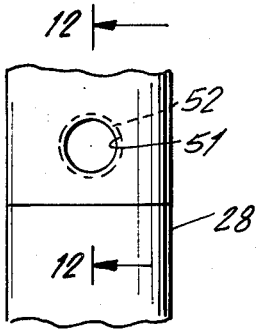
Figure 12:
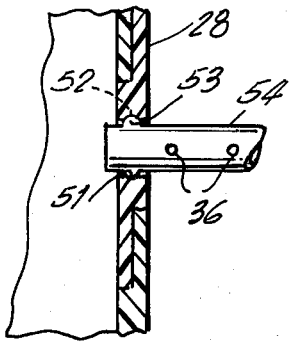

In FIGS. 11 and 12, there is shown an embodiment in which the plug and socket member opening 51 is undercut to provide a socket 52 to receive outwardly extending beads 53 on the end of the tube 54.

Figure 14:
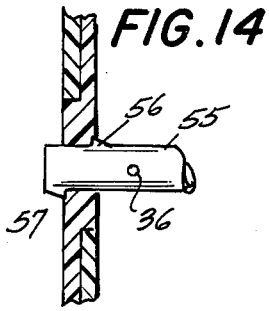
Figure 13:
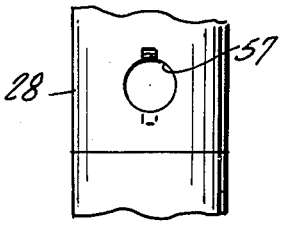

In FIGS. 13 and 14, the tube 55 is provided with outwardly extending teeth 56 which are suitably buttressed so that they snap into the openings 57 in the plug and socket members 28.

From the foregoing, it will be seen that there has been provided apparatus for investment casting which lends itself to quick assembly and positive orientation while, at the same time, permitting a maximum number of small models to be cast at one time.

Having thus fully described the invention, what is desired to be claimed and secured by Letters Patent is:

1. A casting assembly comprising a resilient base, a first recess in the top of said base, a second recess in the base laterally disposed with respect to the first recess and in communication therewith, a sprue forming structure of heat liquifying plastic releasably carried at one end within the base recess and extending upwardly therefrom, said sprue forming structure comprising, coupled, axially bored, plug and socket members and outwardly extending hollow tubes of heat liquifying plastic carried by the plug and socket members in communication with the axial bore, said tubes having openings therein in communication with the interior of the tubes, means to connect heat liquifying models to the tubes, an elongated split ring having outwardly disposed flanged portions on the free ends of the ring, said flanged portions being receivable within said second recess when said ring is received within said first recess at one end said ring extending upwardly from said base around the sprue forming structure and spaced therefrom, and an elongated split pin adapted to be slipped over said flanged portions and within said second recess

2. A casting assembly according to claim 1 in which the plug and socket members are laterally bored to receive one end of the tubes and coupling means to secure the tube ends within the plug and socket bores.

3. A casting assembly according to claim 2 in which the tube end coupling means consists of a wedge formed on one end of each of the tubes and a complimentary keyhole shaped bore in each of the plug and socket members.

4. A casting assembly according to claim 2 in which the tube end coupling means consists of a bead on one end of each of the tubes and a bead receiving under cut portion within the bores of the plug and socket members.

5. A casting assembly according to claim 1 in which the plug and socket members are provided with complimentary keys and keyways to orient and secure adjacent plug and sockets.

* * * * *